US006109940A

United States Patent [19]

Chad et al.

[11] Patent Number: 6,109,940

[45] Date of Patent: Aug. 29, 2000

[54] SHUTTER MECHANISM FOR CARD ADAPTER

[75] Inventors: Michael Chad, San Jose; Steven Hatch, Mountain View; Jeffrey Allen, Pleasanton; Brandt Wiebazhan, San Ramon; Iggoni Fajaro, Fremont; Scott Herbert, Pleasanton, all of Calif.

[73] Assignee: Methode Electronics, Inc., Chicago, Ill.

[21] Appl. No.: 09/169,124

[22] Filed: Oct. 9, 1998

[51] Int. Cl.[7] ..... H01R 13/44

[52] U.S. Cl. ..... 439/141

[58] Field of Search ..... 439/137, 138, 439/140, 141, 155, 945, 946, 325; 361/684, 686, 327

[56] References Cited

U.S. PATENT DOCUMENTS

| | | | |
|---|---|---|---|
| 4,775,327 | 10/1988 | Normann et al. | 439/140 |
| 4,857,005 | 8/1989 | Kikuchi et al. | 439/140 |
| 4,952,161 | 8/1990 | Komatsu | 439/155 |
| 5,035,633 | 7/1991 | Kobayashi et al. | 439/140 |
| 5,457,601 | 10/1995 | Georgopulos et al. | 361/686 |
| 5,889,649 | 3/1999 | Nabetani | 361/684 |

*Primary Examiner*—Khiem Nguyen
*Assistant Examiner*—Brian S. Webb
*Attorney, Agent, or Firm*—Karl D. Kovach; David L. Newman

[57] ABSTRACT

A spring loaded shutter with locking features is used to expose host pins of an adapter to protect the pins from damage and the user from injury. The locking mechanism for the shutter releases when a card is inserted into the host adapter. Engagement of locking pins by the card releases the locking pins and frees the shutter to be pushed backward as the card is connected to the host pins. The shutter is biased in a forward position so that removal of the card from the adapter results in a return of the shutter to its forward locked position where it effectively covers the pins to protect the pins from damage and the user from injury.

20 Claims, 3 Drawing Sheets

SHUTTER MECHANISM FOR CARD ADAPTER

FIELD OF THE INVENTION

The present invention relates generally to type II compact flash cards and adapters therefor. More specifically, the present invention relates generally to host adapters for compact flash cards. Still more specifically, the present invention relates to a shutter mechanism for protecting the contact pins of a host adapter before and during the connection with a flash card.

BACKGROUND OF THE INVENTION

Computers require numerous multi-pin connections between various cards, such as compact flash (F) cards and circuit boards or processors. A typical multi-pin connection may involve fifty pins or more. Further, many signals may be used more than once so that a card having fifty female receptacles may need to be connected to a processor or board having sixty-eight pins. To alleviate this problem, adapters have been developed which include a fifty pin host end for connection to the card and a sixty-eight connector for connection to the board or processor.

However, the connection of the card to the host connector with the fifty outwardly extending pins has proven to be problematic. Specifically, the pins extending from the adapter are exposed and spaced closely together. As a result, the sharp pins can engage a worker's hand or finger thereby causing injury. Further, an incorrect insertion of the card onto the adapter can result in damage to the pins. Once the pins are damaged, the adapter is generally rendered useless due to the time and labor involved in repairing the pins.

Therefore, in order to improve worker's safety and to reduce the number of parts damaged or destroyed during the manufacture of computer components, an improved means for connecting cards such as compact flash cards to host adapters is required. More specifically, a means for protecting the male pins of the host adapter during the process of connecting the adapter to the card is needed.

SUMMARY OF THE INVENTION

The present invention satisfies the aforenoted needs by providing an adapter that comprises a frame having a proximal and a distal end. The frame supports a host member and slidably supports a shutter between the host member and the proximal end of the frame. The adapter further comprises a support disposed between a shutter and a distal end of the frame. The support traps a spring between the support and the shutter which biases the shutter towards the proximal end of the frame. The frame further comprises a recess for pivotally accommodating a locking tab. The locking tab is biased outward from the recess. The locking tab comprises a distal end and a middle portion. The shutter comprises a recess for receiving the distal end of the locking tab. The middle portion of the locking tab extends out of the recess of the frame and is disposed between the shutter and the proximal end of the frame when the distal end of the locking tab is received in the recess of the shutter.

As a result, the shutter is biased forward by the spring disposed between the support and the shutter. In its forward biased position, the shutter surrounds or covers the male pins of the adapter. When the shutter is biased in its forward position, the distal end of the locking tab is accommodated in the recess of the shutter thereby locking the shutter in position.

When a card, such as a compact flash card, is inserted through the proximal end of the frame towards the shutter, the forward end of the card engages the middle portion of the locking tab thereby pushing the locking tab into the recess of the frame and pivoting the distal end of the locking tab out of the recess disposed in the shutter. As a result, the shutter is unlocked from its forward biasing position and pushed back as the card is pushed forward towards the pins of the adapter. The card is continued to be pushed forward until it engages the shutter which is now in an unlocked position. The card pushes the shutter backwards toward the distal end of the frame and the female receptacles of the card slide onto the male pins of the adapter.

In an embodiment, the locking tab further comprises a proximal end that is pivotally connected to the frame.

In an embodiment, the middle portion of the locking tab is curved outwardly away from the frame.

In an embodiment, the locking tab is biased outward from the recess of the frame by a compression spring disposed between the locking tab and the frame.

In an embodiment, the locking tab is pivotally connected to the frame with a pin.

In an embodiment, the frame comprises a slot for slidably receiving a flash card. The recess of the frame being disposed in the slot with the middle portion of the locking tab extending out of the recess of the frame and into the slot for engagement by the flash card as the flash card is pushed towards the shutter.

In an embodiment, shutter comprises a rearwardly extending post that extends through the spring that is trapped between the shutter and the support.

In an embodiment, the host adapter of the present invention comprises two opposing frames which provide a sliding track for the shutter and the flash card. In such an embodiment, at least one of the frame members comprises a support for trapping a spring between the support and the shutter for biasing the shutter towards the proximal ends of the frames and at least one of the frames comprises a recess for pivotally accommodating a locking tab.

In an embodiment, the present invention provides a combination host adapter and flash card which comprises a host adapter comprising two opposing frames, each having a proximal end and a distal end with a slot extending there between. The two frames support a host member between the two frames. The host member comprises a proximal end that comprises a plurality of outwardly extending pins. The slots of the frames also slidably support a shutter between the proximal end of the host member and the proximal ends of the frames. Each of the frames comprises a support for trapping the spring between the support and the shutter for biasing the shutter towards the proximal ends of the frames and over the pins of the host adapter. Each frame further comprises a recess for pivotally accommodating a locking tab. Each locking tab is biased outward from its respective recess and each locking tab comprises a distal end and a middle portion. The shutter also comprises a pair of opposing recesses each of which sees the distal end of one of the locking tabs when the shutter is biased forward over the pins. The receipt of the distal end of the locking tabs in the recesses of the shutter prevents any further forward sliding movement of the shutter and any rearward sliding movement of the shutter. As a result, the shutter stays in place aver the pins thereby protecting the pins. The middle portion of each locking tab is disposed between the shutter and the proximal ends of the frames when the distal ends of the locking tabs are received in the respective recesses of the shutter.

Accordingly, as a flash card is pushed down the slots of the frames toward the shutter, the front end of the flash card engages the outwardly extending middle portions of the locking tabs thereby releasing the distal ends of the locking tabs from the recesses of the shutter. As a result, the shutter is released from its locking position and engagement of the front end of the flash card with the shutter pushes the shutter in a rearward direction towards the distal end of the frames. Continued movement of the flash card results in an engagement of the flash card over the pins of the host adapter.

It is therefore an advantage of the present invention to provide an improved host adapter with a shutter mechanism for protecting the male pins thereof from damage prior to connection of the host adapter to a PC card.

Yet another advantage of the present invention is to provide an improved host adapter with a shutter mechanism that prevents injury from accidental engagement with the pins of the host adapter.

Still another advantage of the present invention is that it provides an improved host adapter and PC card combination.

Yet another advantage of the present invention is that it provides an improved means for protecting the pins of a host adapter prior to and during connection with a compact flash card.

Other objects and advantages of the present invention will become apparent from reading the following detailed description and appended claims, and upon reference to the accompanying drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENT

Figure 1:
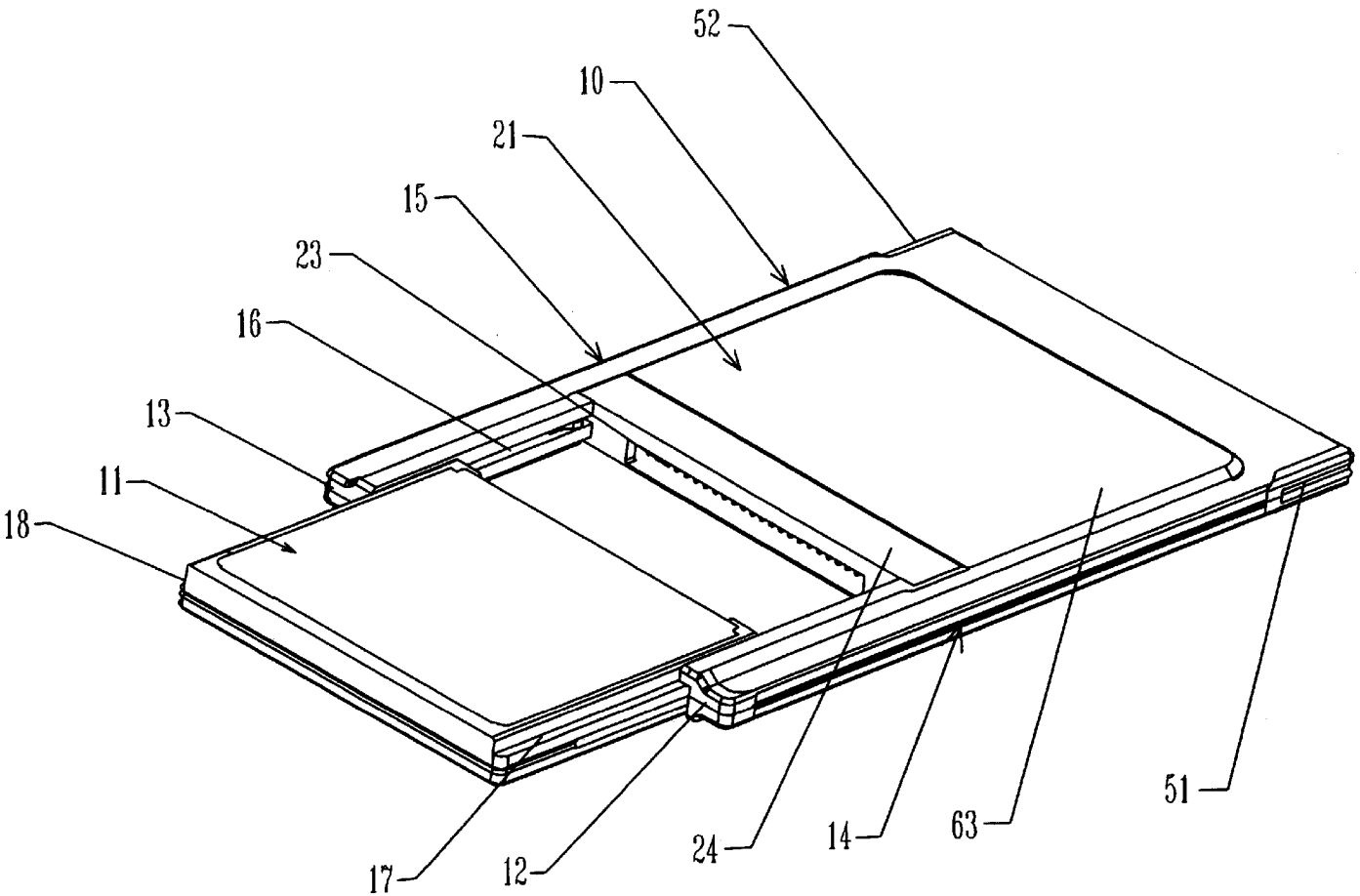
FIG. 1 is a perspective view of a combination host adapter and compact flash card made in accordance with the present invention.

Turning to FIG. 1, a host adapter 10 is shown partially connected to a compact flash (F) card 11. The card 11 has been inserted through the proximal ends 12, 13 of the frame members 14, 15 of the adapter 10. The frame members 14, 15 each include a slot, only one of which is shown at 16 for receiving the opposing sides 17, 18 of the card 11.

The frame members 14, 15 also support a host member 21. At the proximal end 22 of the host member 21 (see FIG. 3), a plurality of pins 23 is provided. In order to protect the pins 23 from damage prior to and during the connection of the pins 23 with the PC card 11, a shutter 24 is provided. The shutter is slidably supported by the frame members 14, 15 as further illustrated in FIG. 2.

Figure 2:
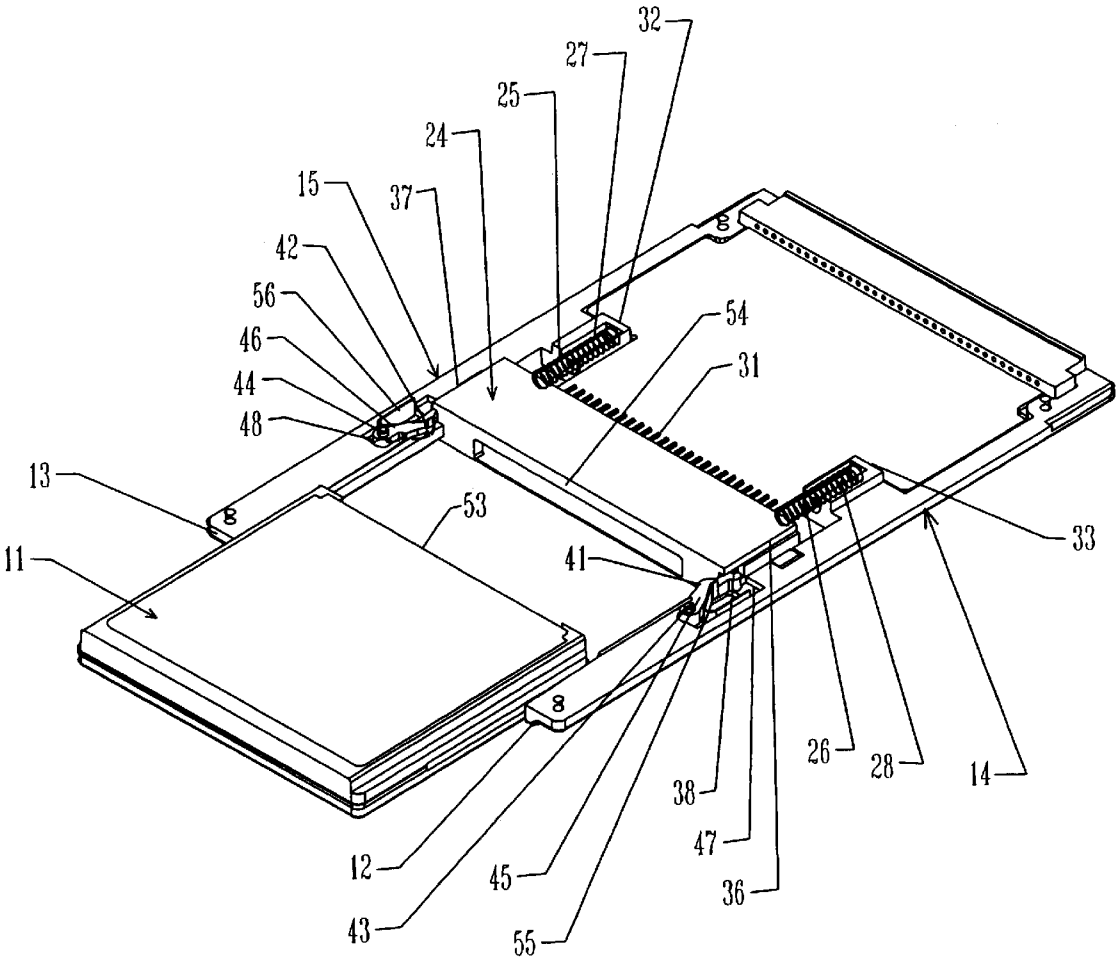
FIG. 2 is a partial perspective view of the combination host adapter and compact flash card shown in FIG. 1.

Turning to FIG. 2, the shutter 24 includes two rearwardly extending posts 25, 26. The posts 25, 26 extend through biasing springs 27, 28 which are trapped between the rear end 31 of the shutter 24 and the supports shown at 32, 33. The supports 32, 33 may be integrally molded with the frame members 15, 14. The springs 27, 28 bias the shutter 24 forward, or towards the proximal ends 12, 13 of the frames 14, 15 as shown in FIG. 2. In this position, recesses 34, 35 disposed in opposing sides 36, 37 of the shutter 24 (see Figure 3) receive hook-shaped distal ends 38, 39 of locking tabs 41, 42 respectively. The tabs 41, 42 are pivotally connected to the frames 14, 15 by way of pins 43, 44 (see FIG. 2). The tabs 41, 42 further include curved middle portions 45, 46 which extend outward from the recesses 47, 48 disposed in the frame members 14, is, respectively.

Therefore, in the position shown in FIG. 2, the springs 27, 28 have biased the shutter 24 forward so that the hook-shaped distal ends 38, 39 of the locking tabs 41, 42 are accommodated in the recesses 34, 35 disposed on opposing sides 36, 37 of the shutter 24. The locking engagement of the distal ends 38, 39 of the locking tabs 41, 42 in the recesses 34, 35 of the shutter 24 prevents both forward and rearward movement of the shutter 24. Thus, in the position shown in FIG. 2, the shutter 24 is locked into position.

However, as the CF card 11 is pushed towards the distal ends 51, 52 of the frames 14, 15, the front end 53 of the card 11 will engage the middle portions 45, 46 of the locking tabs 41, 42. (The locking tabs 41, 42 can move in an inward direction which is toward the recesses 47, 48 or in an outward direction which is away from the recesses 47, 48.) This engagement will push the otherwise outwardly biased locking tabs 41, 42 inward into the recesses 47, 48 disposed in the frames 14, 15 thereby releasing the distal ends 38, 39 of the tabs 41, 42 from the recesses 34, 35 of the shutter 24. As a result, the shutter 24 is unlocked and is free to move rearwardly or towards the distal ends 51, 52 of the frames. Continued forward movement of the card 11 so that the front end 53 of the card 11 engages the front end 54 of the shutter 24 will result in rearward movement of the shutter 24 thereby enabling the card 11 to be mounted onto the pins 23.

It will be noted that the tabs 41, 42 are biased in an outward direction by the compression springs 55, 56 which are trapped between the frames 14, 15 and the tabs 41, 42.

Figure 3:
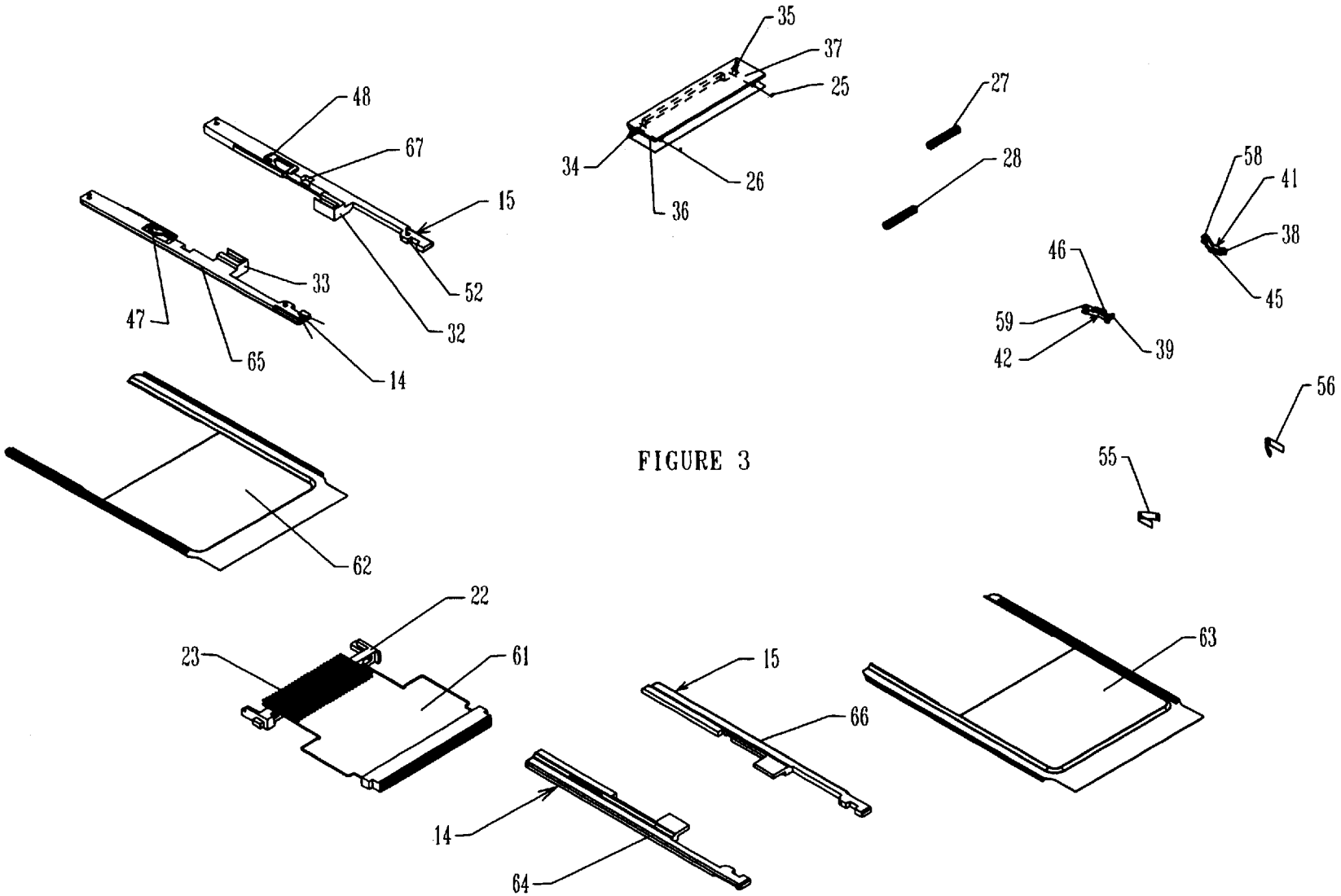
FIG. 3 is an exploded view of the host adapter shown in FIGS. 1 and 2.

In turning to FIG. 3, an exploded view is shown which clearly illustrates the proximal ends 58, 59 of the locking tabs 41, 42. It will be also noticed that the host adapter 21 comprises a card 61 sandwiched between housing member 62, 63. Further, the frames 14, 15 comprise upper and lower members 64, 65 and 66, 67, respectively.

In addition to the helical springs 27, 28 shown, other means for biasing the shutter 24 forward are available such as compression springs. Further, only one spring is needed to bias the shutter 24 forward. Similarly, only one locking tab 41 or 42 is required to lock the shutter 24 in place. The locking tabs 41, 42 may also be disposed in the body of the shutter 24 itself as opposed to being disposed in the frame members 14, 15. Similarly, the guide posts 25, 26 could be eliminated. The support structures 32, 33 may be incorporated into the host adapter 21 as opposed to the frame members 14, 15. These and other alternatives are considered equivalents and within the spirit and scope of the present invention.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An adapter comprising:

a frame having a proximal end and distal end, the frame supporting a host member having a proximal end, the proximal end of the host member comprising a plurality of pins, the frame slidably supporting a shutter between the proximal end of host member and the proximal end of the frame, the adapter further comprising a support disposed between the shutter and the distal end of the frame, the support trapping a spring between the support and the shutter for biasing the shutter towards the proximal end of the frame and over the pins, the frame further comprising a recess for pivotally accommodating a locking tab, the locking tab being biased outward from the recess, the locking tab comprising a distal end and a middle portion, the shutter comprising a recess for receiving the distal end of the locking tab, the middle portion of the locking tab extending out of the recess of the frame and being disposed between the shutter and the proximal end of the frame when the distal end of the locking tab is received in the recess of the shutter, and wherein the shutter comprises a rearwardly extending post that extends through the spring that is trapped between the shutter and the support.

2. The adapter of claim 1 wherein the locking tab further comprises a proximal end that is pivotally connected to the frame.

3. The adapter of claim 1 wherein the middle portion of the locking tab is curved outwardly away from the frame.

4. The adapter of claim 1 wherein the locking tab is biased outward from the recess of the frame by a compression spring disposed between the locking tab and the frame.

5. The adapter of claim 1 wherein the locking tab is pivotally connected to the frame with a pin.

6. The adapter of claim 1 wherein the frame comprises a slot for slidably receiving a flash card, the recess of the frame being disposed in the slot with the middle portion of the locking tab extending out of the recess of the frame and into the slot for engagement by a flash card.

7. A host adapter for connecting to a flash card, the host adapter comprising:

two opposing frames each having a proximal end and distal end, the two frames supporting a host member between the two frames, the host member comprising a proximal end comprising a plurality of pins directed towards the proximal ends of the frames, the two frames slidably supporting a shutter between the proximal end of the host member and the proximal ends of the frames, at least one of the frames comprising a support for trapping a spring between the support and the shutter for biasing the shutter towards the proximal ends of the frames and over the pins, at least one of the frames comprising a recess for pivotally accommodating a locking tab, the locking tab being biased outward from the recess, the locking tab comprising a distal end and a middle portion, the shutter comprising a recess for receiving the distal end of the locking tab and preventing sliding movement of the shutter, the middle portion of the locking tab being disposed between the shutter and the proximal ends of the frames when the distal end of the locking tab is received in the recess of the shutter, whereby engagement of the middle portion of the locking tab by a flash card resulting in pivotal movement of locking tab away from the shutter and the distal end of the locking tab out of the recess of the shutter, and wherein the shutter comprises a rearwardly extending post that extends through the spring that is trapped between the shutter and the support.

8. The host adapter of claim 7 wherein the locking tab further comprises a proximal end that is pivotally connected to the frame.

9. The host adapter of claim 7 wherein the middle portion of the locking tab is curved outwardly away from the frame.

10. The host adapter of claim 7 wherein the locking tab is biased outward from the recess of the frame by a compression spring disposed between the locking tab and the frame.

11. The host adapter of claim 7 wherein the locking tab is pivotally connected to the frame with a pin.

12. The host adapter of claim 7 wherein each frame comprises a slot for slidably receiving a flash card, the recess being disposed in the slot of its respective frame with the middle portion of the locking tab extending out of the recess and into the slot for engagement by a flash card.

13. The host adapter of claim 12 wherein the shutter is slidably mounted in the slots of the opposing frames.

14. A combination host adapter and flash card comprising:

a host adapter comprising two opposing frames each having a proximal end and distal end with a slot extending there between, the two frames supporting a host member between the two frames, the host member comprising a proximal end comprising a plurality of pins, the slots of the frames slidably supporting a shutter between the proximal end of the host member and the proximal ends of the frames, the slots of the frames also slidably receiving a flash card, each frame further comprising a support for trapping a spring between the support and the shutter for biasing the shutter towards the proximal ends of the frames over the pins of the host adapter, each frame further comprising a recess for pivotally accommodating a locking tab, each locking tab being biased outward from its respective recess, each locking tab comprising a distal end and a middle portion, the shutter comprising a pair of opposing recesses, each of the recesses of the shutter receiving the distal end of one of the locking tabs and preventing sliding movement of the shutter, the middle portion of each the locking tab being disposed between the shutter and the proximal ends of the frames when the distal ends of the locking tabs are received in the respective recesses of the shutter, whereby engagement of the middle portions of the locking tabs by the flash card resulting in pivotal movement of the locking tabs away from the shutter and the distal ends of the locking tabs out of the recesses of the shutter, and wherein the shutter comprises a pair of rearwardly extending posts that extend through one of the springs that are trapped between the shutter and one of the supports.

15. The combination of claim 14 wherein each locking tab further comprises a proximal end that is pivotally connected to its respective frame with a pin.

16. The combination of claim 14 wherein the middle portion of the locking tab is curved outwardly away from its respective frame.

17. The combination of claim 14 wherein each locking tab is biased outward from its respective recess by a compression spring disposed between said locking tab and its respective frame.

18. An adapter comprising:

a frame having a proximal end and distal end, the frame supporting a host member having a proximal end, the proximal end of the host member comprising a plurality of pins, the frame slidably supporting a shutter between the proximal end of host member and the proximal end of the frame, the adapter further comprising a support disposed between the shutter and the distal end of the frame, the support trapping a spring between the support and the shutter for biasing the shutter towards the proximal end of the frame and over the pins, the frame further comprising a recess for pivotally accommodating a locking tab, the locking tab being biased outward from the recess, the locking tab comprising a distal end and a middle portion, the shutter comprising a recess for receiving the distal end of the locking tab, the middle portion of the locking tab extending out of the recess of the frame and being disposed between the shutter and the proximal end of the frame when the distal end of the locking tab is received in the recess of the shutter, and wherein the adapter further comprises a post that extends through the spring that is trapped between the shutter and the support.

19. A host adapter for connecting to a flash card, the host adapter comprising:

two opposing frames each having a proximal end and distal end, the two frames supporting a host member between the two frames, the host member comprising a proximal end comprising a plurality of pins directed towards the proximal ends of the frames, the two frames slidably supporting a shutter between the proximal end of the host member and the proximal ends of the frames, at least one of the frames comprising a support for trapping a spring between the support and the shutter for biasing the shutter towards the proximal ends of the frames and over the pins, at least one of the frames comprising a recess for pivotally accommodating a locking tab, the locking tab being biased outward from the recess, the locking tab comprising a distal end and a middle portion, the shutter comprising a recess for receiving the distal end of the locking tab and preventing sliding movement of the shutter, the middle portion of the locking tab being disposed between the shutter and the proximal ends of the frames when the distal end of the locking tab is received in the recess of the shutter, whereby engagement of the middle portion of the locking tab by a flash card resulting in pivotal movement of locking tab away from the shutter and the distal end of the locking tab out of the recess of the shutter, and wherein the adapter further comprises a post that extends through the spring that is trapped between the shutter and the support.

20. A combination host adapter and flash card comprising:

a host adapter comprising two opposing frames each having a proximal end and distal end with a slot extending there between, the two frames supporting a host member between the two frames, the host member comprising a proximal end comprising a plurality of pins, the slots of the frames slidably supporting a shutter between the proximal end of the host member and the proximal ends of the frames, the slots of the frames also slidably receiving a flash card, each frame further comprising a support for trapping a spring between the support and the shutter for biasing the shutter towards the proximal ends of the frames over the pins of the host adapter, each frame further comprising a recess for pivotally accommodating a locking tab, each locking tab being biased outward from its respective recess, each locking tab comprising a distal end and a middle portion, the shutter comprising a pair of opposing recesses, each of the recesses of the shutter receiving the distal end of one of the locking tabs and preventing sliding movement of the shutter, the middle portion of each the locking tab being disposed between the shutter and the proximal ends of the frames when the distal ends of the locking tabs are received in the respective recesses of the shutter, whereby engagement of the middle portions of the locking tabs by the flash card resulting in pivotal movement of the locking tabs away from the shutter and the distal ends of the locking tabs out of the recesses of the shutter, and wherein the adapter further comprises a pair of posts that extend through one of the springs that are trapped between the shutter and one of the supports.

* * * * *

UNITED STATES PATENT AND TRADEMARK OFFICE

CERTIFICATE OF CORRECTION

PATENT NO : 6,109,940
DATED : August 29, 2000
INVENTOR(S) : Chao, et al.

It is certified that error appears in the above-identified patent and that said Letters Patent are hereby corrected as shown below:

Title page, col. 1, line 2, change "Chad et al." to --Chao et al.--;
col. 1, line 5, change "Michael Chad" to --Michael Chao--;
col. 1, line 5, change "Steven" to --Stephen--;
col. 1, line 8, change "Iggoni Fajaro" to --Iggoni Fajardo--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*